US008299846B2

(12) United States Patent
Do

(10) Patent No.: US 8,299,846 B2
(45) **Date of Patent: *Oct. 30, 2012**

(54) INTERNAL VOLTAGE GENERATING CIRCUIT OF SEMICONDUCTOR DEVICE

(75) Inventor: Chang-Ho Do, Kyoungki-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/274,644

(22) Filed: Oct. 17, 2011

(65) Prior Publication Data

US 2012/0032734 A1 Feb. 9, 2012

Related U.S. Application Data

(63) Continuation of application No. 12/815,075, filed on Jun. 14, 2010, now Pat. No. 8,040,177, which is a continuation of application No. 12/164,163, filed on Jun. 30, 2008, now Pat. No. 7,764,110.

(30) Foreign Application Priority Data

Apr. 24, 2008 (KR) ..... 10-2008-0038293

(51) Int. Cl.
*G05F 1/10* (2006.01)

(52) U.S. Cl. ..... 327/540

(58) Field of Classification Search ..... 327/540
See application file for complete search history.

(56) References Cited

U.S. PATENT DOCUMENTS

| | | | | |
|---|---|---|---|---|
| 5,189,316 | A * | 2/1993 | Murakami et al. | 327/530 |
| 5,442,314 | A * | 8/1995 | Hara | 327/543 |
| 5,680,359 | A * | 10/1997 | Jeong | 708/620 |
| 6,058,061 | A * | 5/2000 | Ooishi | 365/222 |
| 6,218,893 | B1 * | 4/2001 | Noguchi | 327/540 |
| 6,333,669 | B1 * | 12/2001 | Kobayashi et al. | 327/541 |
| 6,333,886 | B2 * | 12/2001 | Cho et al. | 365/222 |
| 6,414,527 | B1 * | 7/2002 | Seno et al. | 327/158 |
| 6,448,751 | B1 * | 9/2002 | Becker | 323/284 |
| 6,477,079 | B2 | 11/2002 | Kaneko et al. | |
| 6,763,471 | B1 | 7/2004 | Aoyama | |
| 6,778,460 | B1 | 8/2004 | Jung | |
| 7,205,829 | B2 * | 4/2007 | Herbert et al. | 327/540 |
| 7,227,804 | B1 * | 6/2007 | Kothandaraman et al. | 365/229 |
| 7,286,002 | B1 * | 10/2007 | Jackson | 327/539 |
| 7,319,358 | B2 * | 1/2008 | Senthinathan et al. | 327/538 |
| 7,501,867 | B2 * | 3/2009 | Poulton et al. | 327/156 |
| 7,545,128 | B2 * | 6/2009 | Nakajikkoku | 323/281 |
| 7,724,078 | B2 * | 5/2010 | Kurd et al. | 327/544 |
| 7,764,110 | B2 * | 7/2010 | Do | 327/540 |

(Continued)

OTHER PUBLICATIONS

Search Report issued by the Taiwanese Intellectual Property Office together with the Office Action on Dec. 15, 2011.

*Primary Examiner* — Thomas J Hiltunen
(74) *Attorney, Agent, or Firm* — IP & T Group LLP

(57) ABSTRACT

An internal voltage generating circuit of a semiconductor device includes a first voltage driver configured to pull up an internal voltage terminal during a period where a level of the internal voltage terminal is lower than a target level, and a second voltage driver configured to pull up the internal voltage terminal during a predefined time in each period corresponding to a frequency of an external clock.

23 Claims, 4 Drawing Sheets

U.S. PATENT DOCUMENTS 7,863,944 B2 * 1/2011 Wang et al. ..... 327/97
7,983,106 B2 * 7/2011 Kim et al. ..... 365/226
8,004,348 B2 * 8/2011 Ikenaga et al. ..... 327/540
8,040,177 B2 * 10/2011 Do ..... 327/540
2007/0139097 A1 * 6/2007 Yang ..... 327/530
2009/0063875 A1 * 3/2009 Terazono ..... 713/300

* cited by examiner

INTERNAL VOLTAGE GENERATING CIRCUIT OF SEMICONDUCTOR DEVICE

CROSS-REFERENCE TO RELATED APPLICATIONS

This application is a continuation of U.S. patent application Ser. No. 12/815,075 filed on Jun. 14, 2010 and now issued as U.S. Pat. No. 8,040,177 on Oct. 18, 2011, which is a continuation of U.S. patent application Ser. No. 12/164,163 filed on Jun. 30, 2008 and now issued as U.S. Pat. No. 7,764,110 on Jul. 27, 2010, which claims priority of Korean patent application number 10-2008-0038293 filed on Apr. 24, 2008. The disclosure of each of the foregoing applications is incorporated herein by reference in its entirety.

BACKGROUND OF THE INVENTION

The present invention relates to a semiconductor device, and more particularly, to an internal voltage generating circuit for generating an internal voltage that is maintained at a stable voltage level, regardless of a frequency variation of an external clock.

Most semiconductor devices, e.g., dynamic random access memory (DRAM), include an internal voltage generating circuit inside a chip to generate internal voltages necessary for operations of internal circuits. The internal voltage generating circuit generates internal voltages of various levels by using an external power supply voltage (VDD) and a ground voltage (VSS).

The generation of the internal voltages includes an operation of generating a reference voltage and an operation of charge-pumping or down-converting the generated reference voltage.

Examples of a representative internal voltage generated using the charge pumping operation include a high voltage (VPP) and a back bias voltage (VBB), and examples of a representative internal voltage generated using the down-converting operation include a core voltage (VCORE).

The high voltage (VPP) is a voltage higher than an external power supply voltage (VDD). Upon access to a memory cell, the high voltage (VPP) is applied to a word line connected to a gate of a cell transistor in order to compensate loss of cell data, which is caused by a ID threshold voltage (Vth) of the cell transistor.

The back bias voltage (VBB) is a voltage lower than an external ground voltage (VSS). The back bias voltage (VBB) reduces the variation of the threshold voltage (Vth) of the cell transistor, which is caused by a body effect, thereby improving the operation stability of the cell transistor and reducing a channel leakage current generated at the cell transistor.

The core voltage (VCORE) is a voltage lower than an external power supply voltage (VDD) and higher than a ground voltage (VSS). The core voltage (VCORE) reduces power that is necessary to maintain a voltage level of data stored in a memory cell, and is used for stable operation of the cell transistor.

The internal voltage generating circuit generating the internal voltages (VPP, VBB and VCORE) is designed to operate with a predetermined deviation value within an operating voltage region and an operating temperature range of the semiconductor memory device.

FIG. 1 is a block diagram of a conventional internal voltage generating circuit.

Referring to FIG. 1, the conventional internal voltage generating circuit for generating an internal voltage VINT includes a bandgap reference voltage generator 140, an internal voltage detector 100, and an internal voltage driver 120.

The bandgap reference voltage generator 140 generates a reference voltage VREF_INT that is constantly maintained at a target level, regardless of variation of process, voltage and temperature (PVT) of the semiconductor device. The internal voltage detector 100 detects a level of an internal voltage (VINT) terminal, based on the target level of the reference voltage VREF_INT, to generate an internal voltage detection signal VINT_DET. The internal voltage driver 120 pulls up the internal voltage terminal in response to the internal voltage detection signal VINT_DET.

The internal voltage VINT generated through the above-described processes is input to an internal circuit 160 and enables the internal circuit 160 to perform its internal operation.

Specifically, the internal voltage detector 100 activates the internal voltage detection signal VINT_DET when the level of the internal voltage terminal is lower than the reference voltage VREF_INT that is constantly maintained at the target level, regardless of PVT variation. On the other hand, the internal voltage detector 100 deactivates the internal voltage detection signal VINT_DET when the level of the internal voltage terminal is higher than the reference voltage VREF_INT.

The internal voltage driver 120 pulls up the internal voltage terminal with a predefined drivability when the internal voltage detection signal VINT_DET is in the activated state.

In summary, the internal voltage detector 100 and the internal voltage driver 120 detect the phenomenon that the level of the internal voltage terminal is lowered due to the operation of the internal circuit 160, and make the internal voltage terminal have the target level of the reference voltage VREF_INT.

With respect to the internal voltage terminal, the internal circuit 160 is a current load that is variously variable. That is, the internal circuit 160 may vary the level of the internal voltage VINT when its internal operation is performed according to the operation mode of the semiconductor device.

For example, the internal circuit 160 uses a large amount of the internal voltage VINT in the read/write operation, that is, when the data input/output operations are performed. Thus, reduction in the level of the internal voltage terminal is relatively large. On the other hand, the internal circuit 160 hardly uses the internal voltage VINT in the power-down mode where the data input/output operations are not performed. Thus, reduction in the level of the internal voltage VINT is relatively small.

Therefore, the level of the internal voltage terminal repetitively rises and falls above and below the target level of the reference voltage VREF_INT according to the operations of the internal voltage detector 100, the internal voltage driver 120, and the internal circuit 160.

When the level variation width of the internal voltage terminal, centering on the level of the reference voltage VREF_INT, does not exceed the predefined level width, the operation of the semiconductor device may not be greatly affected.

However, when the level variation width of the internal voltage terminal, centering on the level of the reference voltage VREF_INT, exceeds the predefined level width, the operation of the semiconductor device may not operate normally.

To solve this problem, the level variation width of the internal voltage terminal should be controlled such that it falls within the predefined level width.

To this end, the operating speed of the internal voltage detector 100 has been increased relatively faster. That is, the internal voltage detector 100 detects the level of the internal voltage terminal more frequently during the same time. In this way, the level variation width of the reference voltage terminal, centering on the level of the reference voltage VREF_INT, can fall within the predefined level width.

For example, if the internal voltage detector 100 detects the level variation of the internal voltage terminal relatively frequently, it can detect the level of the level of the internal voltage terminal relatively fast even when it rapidly falls, and operate the internal voltage driver 120. It can prevent the level of the internal voltage terminal from further falling at the moment when the internal voltage driver 120 starts to operate, and it increases the level of the internal voltage terminal. Therefore, it is possible to reduce the level failing width of the internal voltage terminal, centering on the level of the reference voltage VREF_INT.

Likewise, if the internal voltage detector 100 detects the level variation of the internal voltage INT terminal relatively frequently, the rapid rise of the level of the internal voltage terminal due to the operation of the internal voltage driver 120 can be detected relatively fast. Therefore, the operation of the internal voltage driver 120 can be stopped. At the moment when the operation of the internal voltage driver 120 is stopped, the level of the internal voltage terminal does not further rise and immediately falls. Consequently, the level rise width of the internal voltage terminal, centering on the reference voltage VREF_INT, can be reduced.

However, a predetermined amount of current is consumed whenever the internal voltage detector 100 detects the level of the internal voltage terminal. Thus, an amount of current relatively increases when the internal voltage detector 100 detects the level of the internal voltage terminal relatively frequently. If the operating speed of the internal voltage detector 100 increases, an amount of current consumed in the semiconductor device will considerably increase.

In addition, despite the fact that the case where the level of the internal voltage terminal slowly changes occurs more often than the case where the level of the internal voltage terminal rapidly changes, it is unreasonable to increase the operating speed of the internal voltage detector 100 in order for preparing for the case where the level of the internal voltage terminal rapidly changes.

This means that increasing the operating speed of the internal voltage detector 100 is allowed to some extent. Increasing the operating speed of the internal voltage detector 100 in order to prevent the rapid level variation of the internal voltage terminal has the tradeoff relationship with increase in an amount of current consumed in the internal voltage detector 100. To solve the two problems at a time, the designer must find the level variation width of the internal voltage terminal having a relatively low error probability through various test operations, and design the semiconductor device such that it performs the operation of properly maintaining the operating speed of the internal voltage detector 100 so that the semiconductor device can operate normally without greatly increasing the current consumption.

Meanwhile, the level of the power supply voltage VDD supplied to the semiconductor device is gradually lowered and the operating speed of the semiconductor device is gradually increasing.

The fast operating speed of the semiconductor device means that the frequency of the external clock applied to the semiconductor device is high. That is, as the frequency of the external clock is increasing, the semiconductor device can operate at higher speed.

Also, the high-speed operation of the semiconductor device as the frequency of the external clock increases means that the internal circuit 160 of the semiconductor device will use the internal voltage VINT much more. That is, it means that the level of the internal voltage terminal may change more rapidly.

Due to the increased frequency of the external clock, the level of the internal voltage terminal changes more rapidly. Even though the internal voltage detector 100 and the internal voltage driver 120 operate at the typical speed, it is impossible to prevent the phenomenon that the level of the internal voltage terminal rises and falls centering on the level of the internal voltage terminal.

That is, it is impossible to prevent the increase in the level variation width of the internal voltage terminal, which is caused by the increased frequency of the external clock, at the operating speed of the internal voltage detector 100 where its error probability is low and its current consumption is not greatly increased. Therefore, the semiconductor device cannot operate normally, increasing the error probability.

Increasing the operating speed of the internal voltage detector 100 without any preparation will cause the above-described problem that an amount of current consumed in the semiconductor device is increased too much.

Therefore, whenever the operating speed of the semiconductor device changes, that is, when the frequency of the external clock applied to the semiconductor device changes, the designer must again find the level variation width of the internal voltage terminal having a relatively low error probability through test operations, and design the semiconductor device such that it performs the operation of properly maintaining the operating speed of the internal voltage detector 100 so that the semiconductor device can operate normally without greatly increasing the current consumption.

SUMMARY OF THE INVENTION

Embodiments of the present invention are directed to providing an internal voltage generating circuit including a driver for driving an internal voltage terminal according to a frequency of an external clock, which is capable of generating an internal voltage that is maintained at a stable voltage level, regardless of a frequency variation of an external clock.

In accordance with an aspect of the present invention, there is provided an internal voltage generating circuit of a semiconductor device, including: a first voltage driver configured to pull up an internal voltage terminal during a period where a level of the internal voltage terminal is lower than a target level; and a second voltage driver configured to pull up the internal voltage terminal during a predefined time in each period corresponding to a frequency of an external clock.

In accordance with another aspect of the present invention, there is provided an internal voltage generating circuit of a semiconductor device, including: a first driving control pulse generator configured to detect a level of an internal voltage terminal, based on a target level, and generate a first driving control pulse having an activation period varying according to the detection result; a first driver configured to pull up the internal voltage terminal in response to the first driving control pulse; a second driving control pulse generator configured to generate a second driving control pulse having an activation period in each period corresponding to a frequency of an external clock; and a second driver configured to pull up the internal voltage terminal in response to the second driving control pulse.

In accordance with another aspect of the present invention, there is provided an internal voltage generating method of a semiconductor device, including: selectively pulling up an internal voltage terminal according to a level of the internal voltage terminal; and pulling up the internal voltage terminal according to a frequency of an external clock.

DESCRIPTION OF SPECIFIC EMBODIMENTS

Hereinafter, an internal voltage generating circuit in accordance with the present invention will be described in detail with reference to the accompanying drawings.

Figure 1:
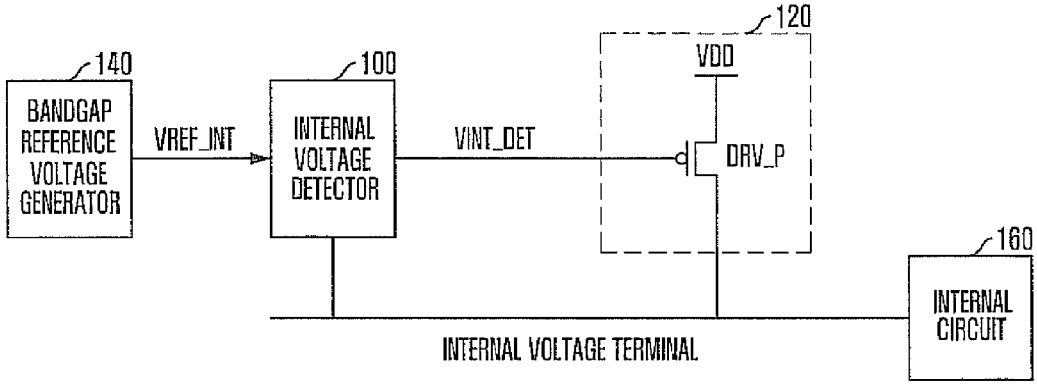
FIG. 1 (RELATED ART)
FIG. 1 is a block diagram of a conventional internal voltage generating circuit.
Figure 2:
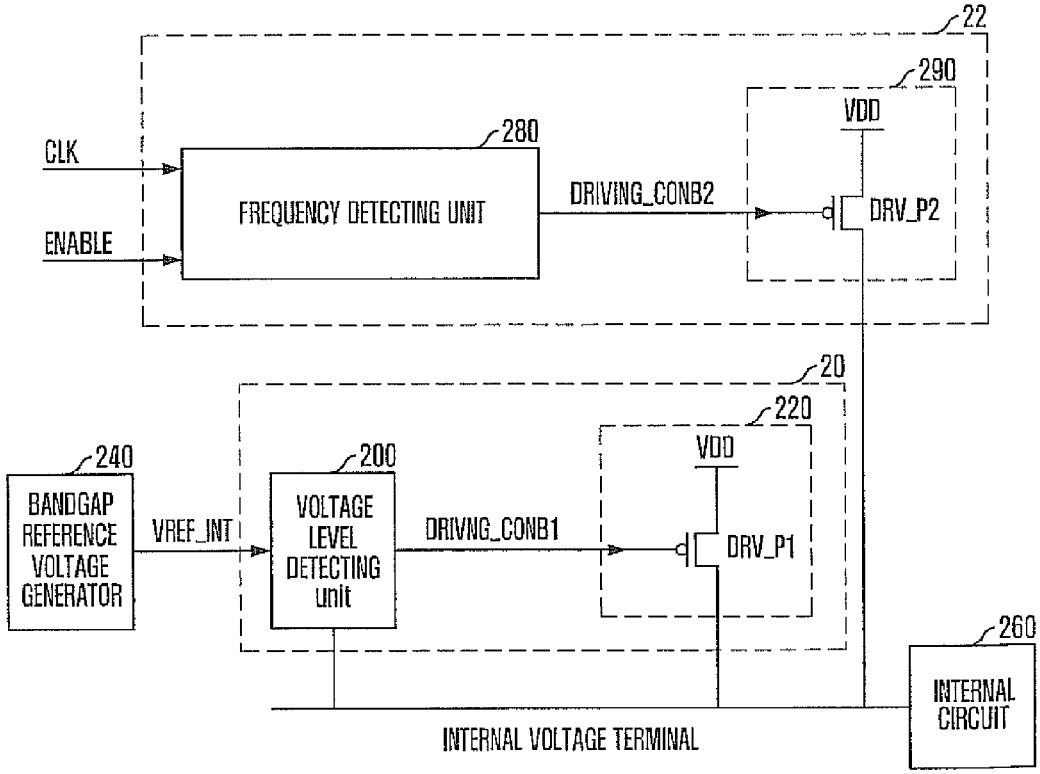
FIG. 2 is a block diagram of an internal voltage generating circuit in accordance with an embodiment of the present invention.

FIG. 2 is a block diagram of an internal voltage generating circuit in accordance with an embodiment of the present invention.

Specifically, FIG. 2 illustrates the internal voltage generating circuit using a down converting scheme. However, the internal voltage generating circuit of FIG. 2 has no great difference from that using a charge pumping scheme. That is, the charge pumping scheme is the same as the down converting scheme in the operation of detecting the level of the internal voltage terminal and the operation of driving the internal voltage terminal according to the detection result.

Although the charge pumping scheme is different from the down converting scheme in the detailed circuits for detecting the level of the internal voltage terminal and driving the internal voltage terminal, the circuit configuration for implementing the down converting scheme is much easier than that for implementing the charge pumping scheme. Therefore, the following description will be made about the circuit for generating the internal voltage (VINT) using the down converting scheme.

The internal voltage generating circuit in accordance with the embodiment of the present invention can be applied to the circuit for generating the internal voltage (VINT) using the charge pumping scheme, as well as the circuit for generating the internal voltage (VINT) using the down converting scheme.

Referring to FIG. 2, the internal voltage generating circuit includes a bandgap reference voltage generator 240, a first voltage driver 20 and a second voltage driver 22. The bandgap reference voltage generator 240 generates a reference voltage VREF_INT that is constantly maintained at a target level, regardless of PVT variation of the semiconductor device. The first voltage driver 20 pulls up an internal voltage terminal during a period where the level of the internal voltage terminal is lower than the target level of the reference voltage VREF_INT. The second driver 22 pulls up the internal voltage terminal during a predefined time in each period corresponding to the frequency of an external clock CLK.

The first voltage driver 20 includes a voltage level detecting unit 200 and a first internal voltage driving unit 220. The voltage level detecting unit 200 detects the level of the internal voltage terminal, based on the target level of the reference voltage VREF_INT, and generates a first driving control pulse DRIVING_CONB1 having an activation period varying according to the detection result. The first internal voltage driving unit 220 pulls up the internal voltage terminal in response to the first driving control pulse DRIVING_CONB1.

The second voltage driver 22 includes a frequency detecting unit 280 and a second internal voltage driving unit 290. The frequency detecting unit 280 detects the frequency of the external clock CLK, and generates a second driving control signal DRIVING_CONB2 having an activation period in each period varying according to the detection result. The second internal voltage driving unit 290 pulls up the internal voltage terminal in response to the second driving control signal DRIVING_CONB2.

Through the above-described procedures, the internal voltage VINT is input to an internal circuit 260 of the semiconductor device and enables the internal circuit 260 to perform its internal operation.

Specifically, the voltage level detecting unit 200 of the first voltage driver activates the first driving control pulse DRIVING_CONB1 during a period where the level of the internal voltage terminal is lower than the level of the reference voltage VREF_INT, and deactivates the first driving control pulses DRIVING_CONB1 during a period where the level of the internal voltage terminal is higher than the level of the reference voltage VREF_INT.

Therefore, the timing or duration of the activation period of the first driving control pulse DRIVING_CONB1 do not have predefined values. More specifically, as the internal circuit 260 performs the predefined internal operation, the first driving control pulse DRIVING_CONB1 is activated when the level of the internal voltage terminal becomes lower than the level of the reference voltage VREF_INT, and enables the first internal voltage driving unit 220 to pull up the internal voltage terminal. The first driving control pulse DRIVING_CONB1 is deactivated when the level of the internal voltage terminal becomes higher than the level of the reference voltage VREF_INT due to the pull-up driving operation of the first internal voltage driving unit 220, and stops the pull-up driving operation of the first internal voltage driving unit 220.

The frequency detecting unit 280 of the second voltage driver activates the second driving control pulse DRIVING_CONB2 in response to the predefined toggling numbers of the external clock CLK, and deactivates the second driving control pulse DRIVING_CONB2 after a predetermined time elapses from the activation.

That is, the second driving control pulse DRIVING_CONB2 is activated whenever the period (tCK) of the external clock CLK is repeated by the predefined numbers, and is automatically deactivated after the predefined time elapses.

At this point, when the frequency of the external clock CLK is relatively high and thus one clock (tCK) of the external clock CLK is relatively short, it takes a relatively short time for the external clock CLK to toggle by the predefined numbers.

On the contrary, when the frequency of the external clock CLK is relatively low and thus one clock (tCK) of the external clock CLK is relatively long, it takes a relatively long time for the external clock CLK to toggle by the predefined numbers. In this case, it takes a relative long time until the second driving control pulse DRIVING_CONB2 is again activated.

For example, assuming that the second driving control pulse DRIVING_CONB2 is activated whenever the external clock CLK is toggled sixteen times, and the frequency of the external clock CLK is 1 GHz, one period (tCK) of the external clock CLK is 1 nanosecond and the second driving control pulse DRIVING_CONB2 is activated in every 16 nanoseconds.

Likewise, assuming that the second driving control pulse DRIVING_CONB2 is activated whenever the external clock CLK is toggled sixteen times, and the frequency of the external clock CLK is 250 MHz, one period (tCK) of the external clock CLK is 4 nanoseconds and the second driving control pulse DRIVING_CONB2 is activated in every 64 nanoseconds.

Therefore, the activation timing of the second driving control pulse DRIVING_CONB2 can be predicted according to the frequency of the external clock CLK, and the duration of the activation period is previously determined. Therefore, the second driving control pulse DRIVING_CONB2 is activated in each period varying according to the frequency of the external clock CLK, regardless of the operation of the internal circuit 260 or the level of the internal voltage VINT, and enables the second internal voltage driving unit 290 to pull up the internal voltage terminal. After a predefined time elapses, the second driving control pulse DRIVING_CONB2 is deactivated to stop the pull-up driving operation of the second internal voltage driving unit 290.

Figure 3:
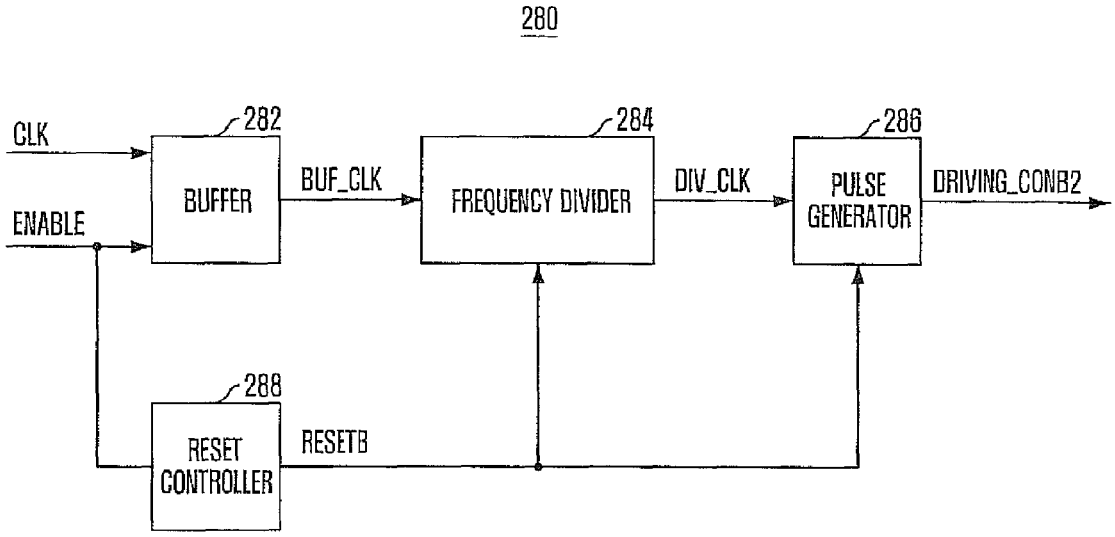
FIG. 3 is a block diagram of a frequency detecting unit of FIG. 2 in accordance with an embodiment of the present invention.

FIG. 3 is a block diagram of the frequency detecting unit of FIG. 2 in accordance with an embodiment of the present invention.

Referring to FIG. 3, the frequency detecting unit 280 includes a buffer 282, a frequency divider 284, and a pulse generator 286. The buffer 282 buffers the external clock CLK to output a buffered clock BUF_CLK in response to an operation control signal ENABLE. The frequency divider 284 divides the buffered clock BUF_CLK by predefined multiple. The pulse generator 286 generates the second driving control pulse DRIVING_CONB2 having the predefined activation period at each edge of the divided clock DIV_CLK output from the frequency divider 284. In addition, the frequency detecting unit 280 further includes a reset controller 288 for resetting the frequency divider 284 and the pulse generator 286 in response to the operation control signal ENABLE.

Figure 4A:
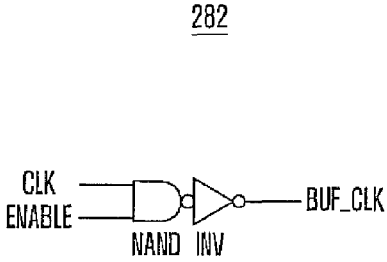
FIG. 4A is a circuit diagram of a buffer of FIG. 3.

FIG. 4A is a circuit diagram of the buffer of FIG. 3.

Referring to FIG. 4A, the buffer 282 includes a NAND gate NAND configured to perform a NAND operation on the external clock CLK and the operation control signal ENABLE, and an inverter INV configured to invert a phase of an output signal of the NAND gate NAND to output the buffered clock BUF_CLK.

That is, the buffer 282 buffers the external clock CLK to output the buffered clock BUF_CLK only when the operation control signal ENABLE is activated to a logic high level, and does not buffer the external clock when the operation control signal ENABLE is deactivated to a logic 1 low signal.

The operation control signal ENABLE may be a clock enable signal (CKE) whose logic level varies according to the entry state of a power down mode, or may be a column enable signal whose logic level varies according to the data input/output operation.

For example, in case where the operation control signal ENABLE is the same as the clock enable signal CKE, the buffer 282 does not buffer the external clock CLK when the semiconductor device enters the power down mode, but buffers the external clock CLK when the semiconductor device exits the power down mode.

Likewise, in case where the operation control signal ENABLE is the same as the column enable signal, the buffer 282 buffers the external clock CLK while the semiconductor device performs the data input/output operation in response to a read command RD or a write command WR, but does not buffer the external clock CLK while the semiconductor device does not perform the data input/output operation.

Figure 4B:
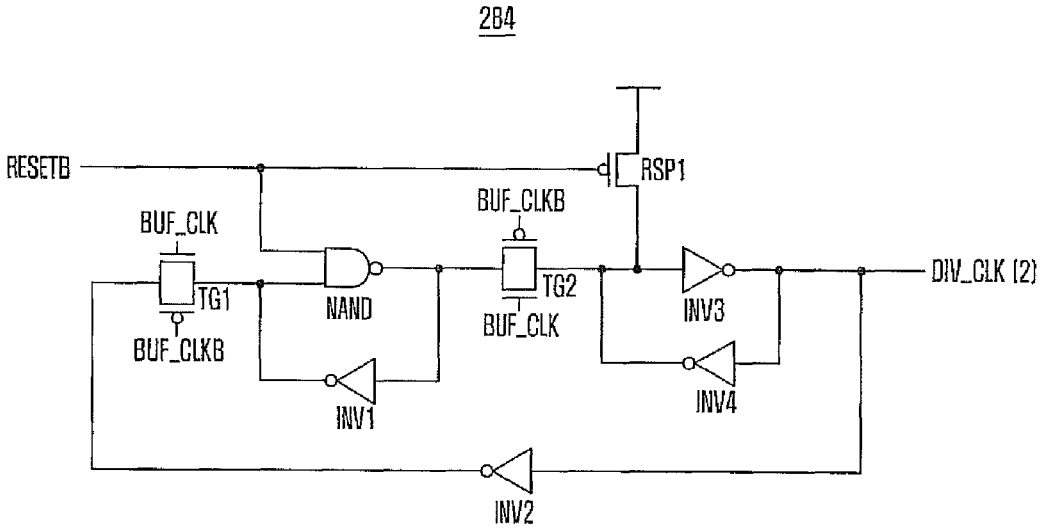
FIG. 4B is a circuit diagram of a frequency divider of FIG. 3.

FIG. 4B is a circuit diagram of the frequency divider of FIG. 3.

For reference, the frequency divider 284 in accordance with the embodiment of the present invention includes a plurality of the circuit of FIG. 4B connected in series.

Although the frequency divider 284 of FIG. 4B outputs a 2X divided clock DIV_CLK(2) having two times period of the buffered clock BUF_CLK in response to the buffered clock BUF_CLK, it may include a circuit configured to output a 4X divided clock (DIV_CLK(4)) having two times period of the 2X divided clock DIV_CLK(2), consequently four times period of the buffered clock BUF_CLK. Also, the frequency divider 284 may include a circuit configured to output a 8X divided clock (DIV_CLK(8)) having two times period of the 4X divided clock (DIV_CLK(4)), consequently eight times period of the buffered clock BUF_CLK. In summary, the frequency divider 284 may include a circuit configured to output a $2^N$X divided clock (DIV CLK($2^N$)) having two times period of a $2^{N-1}$X divided clock DIV_CLK($2^{N-1}$), consequently $2^N$ times period of the buffered clock BUF_CLK, where N is integer.

Referring to FIG. 4B, the circuit of the frequency divider 284 is a known circuit. That is, any circuit that can divide the input frequency by a predefined multiple can be applied to the frequency divider 284.

The operation of the frequency divider 284 of FIG. 4 will be described below.

The logic level of the 2X divided clock DIV_CLK(2) determined when the buffered clock BUF_CLK is activated to a logic high is maintained without change even when the buffered clock BUF_CLK is deactivated to a logic low level, and the 2X divided clock DIV_CLK(2) is oscillated. In this way, the 2X divided clock DIV_CLK(2) has two times period of the buffered clock BUF_CLK.

In addition, all operations are reset when the reset signal RESETB output from the reset controller 288 is activated to a logic low level.

Figure 4C:
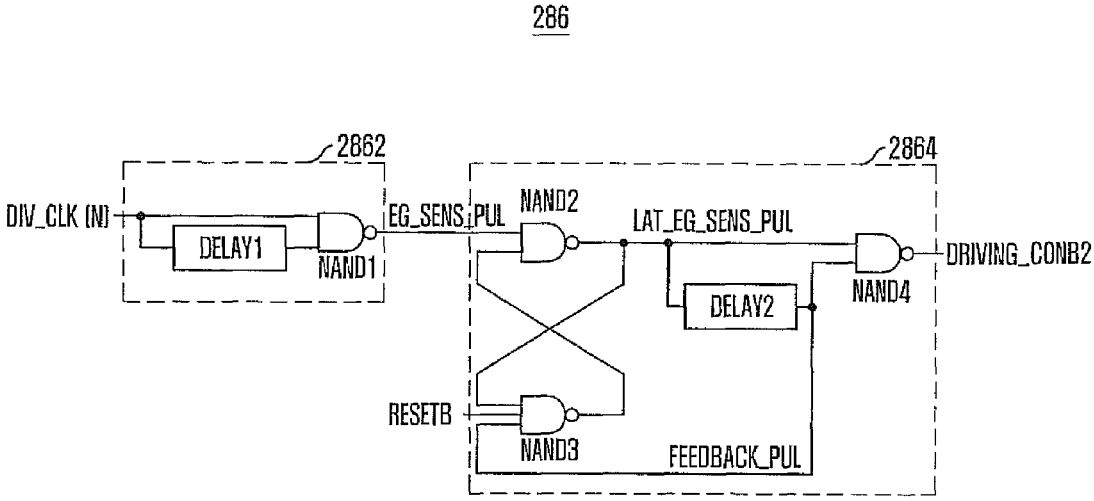
FIG. 4C is a circuit diagram of a pulse generator of FIG. 3.

FIG. 4C is a circuit diagram of the pulse generator of FIG. 3.

Referring to FIG. 4C, the pulse generator 286 includes a clock edge detecting unit 2862 and a pulse output unit 2864. The clock edge detecting unit 2862 detects an edge of the N-X (N-time) divided clock DIV_CLK(N) output from the frequency divider 284. The pulse output unit 2864 outputs the second driving control signal DRIVING_CONB2 that is activated for a predefined time in response to the output signal EG_SENS_PUL of the clock edge detecting unit 2862.

The clock edge detecting unit 2862 includes a first delay element DELAY1 and a NAND gate NAND1. The first delay element DELAY1 delays the N-X divided clock DIV_CLK (N) by a first time and inverts its phase. The first NAND gate NANDI performs a NAND operation on the N-X divided clock DIV_CLK(N) and an output clock of the first delay element DELAY1 to output the clock edge detection pulse EG_SENS_PUL.

The clock edge detecting unit 2862 operates to output the clock edge detection pulse EG_SENS_PUL that is toggled in response to the rising edge of the N-X divided clock DIV_CLK(N).

The clock edge detecting unit 2862 in accordance with the embodiment of the present invention can also be configured to output the clock edge detection pulse EG_SENS_PUL that is toggled in response to a falling edge of the N-X divided clock DIV_CLK(N) or both a rising edge and a falling edge of the N-X divided clock DIV_CLK(N).

The pulse output unit 2864 includes a second NAND gate NAND2, a third NAND gate NAND3, a second delay element DELAY2, and a fourth NAND gate NAND4. The second NAND gate NAND2 and the third NAND gate NAND3 are configured to latch a pulse LAT_EG_SENS_PUL corresponding to the clock edge detection clock EG_SENS_PUL in response to a feedback pulse FEEDBACK_PUL. The second delay element DELAY2 delays the pulse LAT_EG_SENS_PUL corresponding to the clock edge detection clock EG_SENS_PUL for a second time and inverts its phase. The fourth NAND gate NAND4 performs a NAND operation on the pulse LAT_EG_SENS_PUL corresponding to the clock edge detection clock EG_SENS_PUL and an output clock of the second delay element DELAY2 to output the second driving control pulse DRIVING_CONB2.

Specifically, at the moment when the clock edge detection pulse EG_SENS_PUL input to the pulse output unit 2864 changes from a logic high level to a logic low level, the pulse LAT_EG_SENS_PUL corresponding to the clock edge detection pulse EG_SENS_PUL is activated from a logic low level to a logic high level. However, the feedback pulse FEEDBACK_PUL is maintained at a logic high level for the second time due to the second delay element DELAY2. Therefore, the second driving control pulse DRIVING_CONB2 is activated from a logic high level to a logic low level and is maintained in the activated state for the second time due to the second delay element DELAY2.

At this point, even though the clock edge detection pulse EG_SENS_PUL input to the pulse output unit 2864 changes from a logic low level to a logic high level, the second NAND gate NAND2 and the third NAND gate NAND3 is performing the latching operation because the second time does not elapse if the feedback pulse FEEDBACK_PUL is maintained at the logic high level. Therefore, the pulse LAT_EG_SENS_PUL corresponding to the clock edge detection pulse EG_SENS_PUL is kept in the activated state, that is, the logic high level.

In such a state, if the second time elapses after the pulse LAT_EG_SENS_PUL corresponding to the clock edge detection pulse EG_SENS_PUL is activated from a logic low level to a logic high level, the feedback pulse FEEDBACK_PUL changes from a logic high level to a logic low level. In this case, the second driving control pulse DRIVING_CONB2 is deactivated from a logic low level to a logic high level.

If the clock edge detection pulse EG_SENS_PUL input to the pulse output unit 2864 changes from a logic low level to a logic high level, the latching operation of the second NAND gate NAND2 and the third NAND gate NAND3 are finished at the same—very slight later—when the second driving control pulse DRIVING_CONB2 is deactivated from a logic low level to a logic high level. Thus, the pulse LAT_EG_SENS_PUL corresponding to the clock edge detection pulse EG_SENS_PUL is deactivated to a logic low level.

When the reset signal RESETB output from the reset controller 288 is deactivated to a logic low level, the latching operation of the second NAND gate NAND2 and the third NAND gate NAND3 is always finished, so that the second driving control pulse DRIVING_CONB2 always changes to an initial state of a logic high level.

Figure 5:
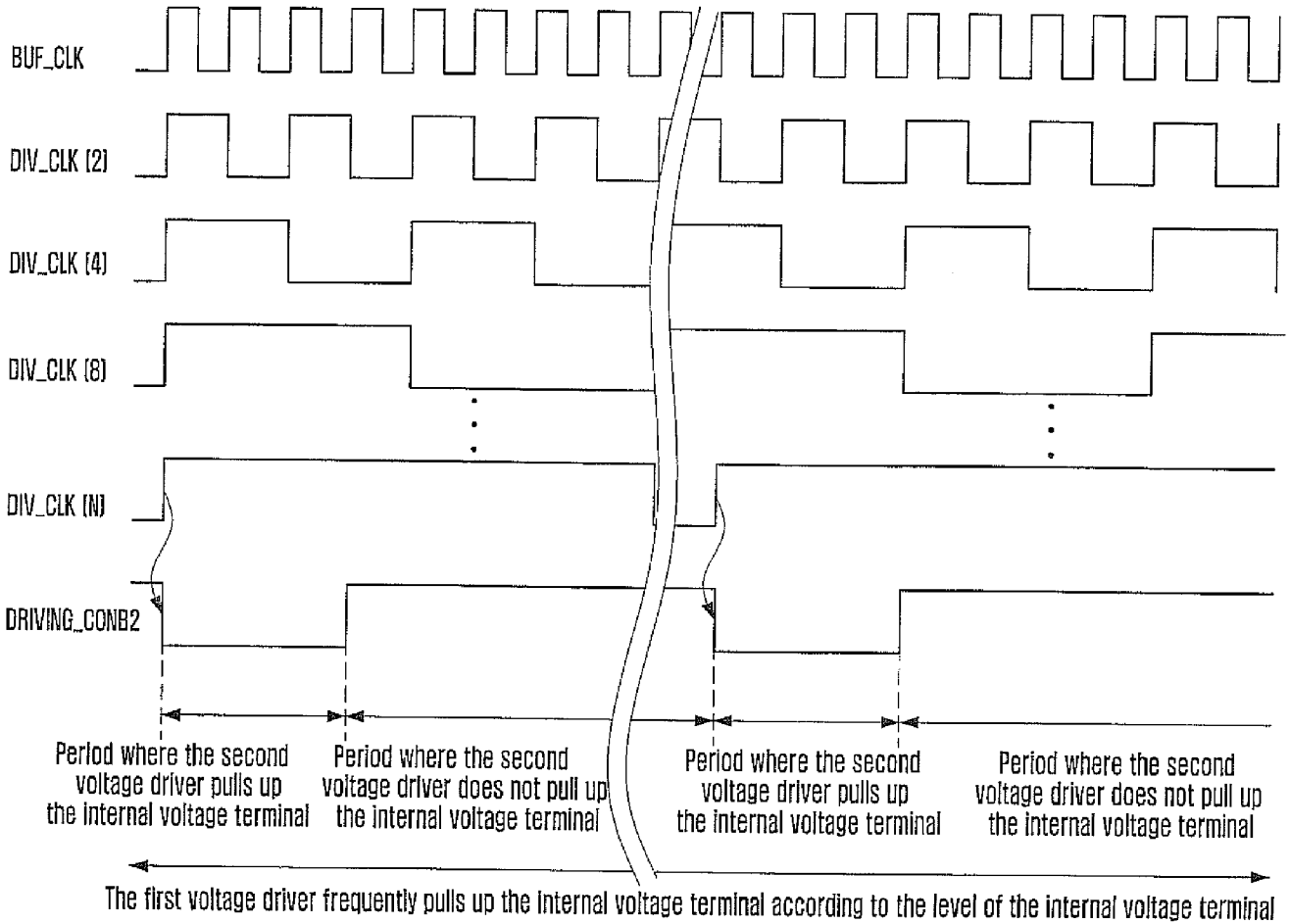
FIG. 5 is a timing diagram of signals that are input and output to/from the frequency detecting unit of FIG. 3.

FIG. 5 is a timing diagram of signals that are input and output to/from the frequency detecting unit of FIG. 3.

Referring to FIG. 5, the signal input to the frequency detecting unit 280 is generated by buffering the external clock CLK. Thus, the clock edge of the buffered clock BUF_CLK is synchronized with the external clock CLK. The frequency detecting unit 280 outputs the second driving control pulse DRIVING CONB2 for controlling the turning on/off of the pull-up operation of the second internal voltage driving unit 290.

Specifically, when the buffered clock BUF_CLK synchronized with the external clock CLK has a first frequency, the 2X divided clock DIV_CLK(2) has a second frequency corresponding to ½ of the first frequency, and the 4X divided clock DIV_CLK(4) has a third frequency corresponding to ¼ of the first frequency, that is, ½ of the second frequency. Also, the 8X divided clock DIV_CLK(8) has a fourth frequency corresponding to ⅛ of the first frequency, that is, ¼ of the second frequency, that is, ½ of the third frequency.

Furthermore, the N-X divided clock DIV_CLK(N) output from the frequency divider 284 of the frequency detecting unit 280 has an N-th frequency corresponding to $1/2^N$ of the first frequency.

As described above, when the frequency divider 284 of the frequency detecting unit 280 generates the N-X divided clock DIV_CLK(N), the pulse generator 286 activates the second driving control pulse DRIVING_CONB2 to a logic low level in response to the clock edge of the N-X divided clock DIV_CLK(N).

The second driving control pulse DRIVING_CONB2 activated to a logic low level is automatically deactivated to a logic high level after a predefined time elapses.

Furthermore, the period where the second driving control pulse DRIVING_CONB2 is activated to a logic low level is a period where the second voltage driver 22 pulls up the internal voltage terminal, and the period where the second driving control pulse DRIVING_CONB2 is deactivated to a logic high level is a period where the second voltage driver 22 does not pull up the internal voltage terminal.

Although not illustrated, the first voltage driver 20 pulls up the internal voltage terminal according to the level of the internal voltage terminal, independently of the operation of the second voltage driver 22.

In such a state that the first voltage driver 20 for driving the internal voltage terminal according to the level variation of the internal voltage terminal is provided, the semiconductor device further includes the second voltage driver 22 for driving the internal voltage terminal at periods varying according to the frequency of the external clock CLK, regardless of the level variation of the internal voltage VINT. Thus, even though the frequency of the external clock CLK changes, especially the frequency of the external clock CLK increases, it is possible to prevent the increase of the level variation width of the internal voltage terminal rising and falling centering on the level of the reference voltage VREF_INT.

That is, even though the frequency of the external clock CLK increases, the second voltage driver 22 automatically drives the internal voltage terminal properly. Therefore, it is possible to prevent the unstable swing of the level of the internal voltage terminal.

Hence, even though the frequency of the external clock CLK changes, the level variation width of the internal voltage terminal does not increase. Since the design of the first voltage driver 20 need not be modified, the structure and operation of the semiconductor device need not be greatly modified with respect to the frequency variation of the external clock CLK. In developing the semiconductor device, it is possible to well cope with the frequency variation of the external clock CLK. The development time is reduced and thus the cost reduction is achieved.

In addition, since the level variation width of the internal voltage terminal does not increase even though the frequency of the external clock changes, it is unnecessary to frequently detect the whether the level of the internal voltage terminal exceeds the predefined variation range, thereby minimizing an amount of current consumed during the detecting operation.

Furthermore, by properly controlling the operation control signal ENABLE for controlling the operation of the second voltage driver 22, the period where the second voltage driver 22 operates can be limited to the period where the internal circuit 260 uses the internal voltage VINT relatively much.

For example, the second voltage driver 22 is controlled to operate only during the activation period of the column enable signal, where the data input/output operations are actively performed, and it is controlled to be disabled during the other periods. In this way, an amount of current consumed by the unnecessary operations can be minimized.

As described above, by providing the first driver for driving the internal voltage terminal according to the level variation of the internal voltage terminal and the second driver for driving the internal voltage terminal according to the frequency of the external clock, the level of the internal voltage terminal can be stably maintained at the target level, without modifying the structure and operation of the first driver, even though the frequency of the external clock changes.

Therefore, it is possible to flexibly cope with the variation of the frequency in the development of the semiconductor device. Hence, the development time and is reduced and thus the cost reduction is achieved.

Furthermore, the level variation width of the internal voltage terminal is not increased even though the frequency of the external clock changes. Therefore, the number of the operation of detecting the level of the internal voltage terminal is reduced. Consequently, it is possible to minimize an amount of current consumed for stabilizing the level of the internal voltage terminal.

While the present invention has been described with respect to the specific embodiments, it will be apparent to those skilled in the art that various changes and modifications may be made without departing from the spirit and scope of the invention as defined in the following claims.

In the above embodiments, the locations and types of the logic gates and transistors may be modified according to the polarities of the input signals.

What is claimed is:

1. A semiconductor device, comprising:

a level detecting unit configured to detect a voltage level of an internal voltage terminal based on the a target level;

a first driving unit configured to pull up the voltage level of the internal voltage terminal in response to an output signal of the level detecting unit;

a frequency detecting unit configured to detect a frequency of an external clock and generate a periodic driving control signal having a predefined activation period in each period varying according to the detection result of the frequency detecting unit; and a second driving unit configured to pull up the voltage level of the internal voltage terminal in response to the periodic driving control signal, regardless of a level variation of the voltage level of the internal voltage terminal, wherein the frequency detecting unit comprises:

a buffer configured to buffer the external clock in response to an operation control signal;

a frequency divider configured to divide an output clock of the buffer by a predefined multiple; and a detection pulse generator configured to generate the periodic driving control signal having the predefined activation pulse width at each edge of a clock output from the frequency divider.

2. The semiconductor device as recited in claim 1, further comprising a bandgap reference voltage generator configured to generate a reference voltage which is constantly maintained at the target level, regardless of process, voltage and temperature (PVT) of the semiconductor device.

3. The semiconductor device as recited in claim 1, wherein the level detecting unit generates a first driving control pulse having an activation period varying according to the detection result of the level detecting unit.

4. The semiconductor device as recited in claim 1, wherein the frequency detecting unit further comprises a reset controller configured to reset the frequency divider and the detection pulse generator in response to the operation control signal.

5. The semiconductor device as recited in claim 1, wherein the operation control signal comprises a clock enable signal.

6. The semiconductor device as recited in claim 1, wherein the operation control signal comprises a column enable signal.

7. The semiconductor device as recited in claim 1, wherein the detection pulse generator comprises:

a clock edge detecting unit configured to detect an edge of a clock output from the frequency divider; and a detection pulse output unit configured to activate the periodic driving control signal for a predefined time in response to an output signal of the clock edge detecting unit.

8. The semiconductor device as recited in claim 7, wherein the clock edge detecting unit outputs a rising edge detection signal that is toggled in response to a rising edge of the clock output from the frequency divider.

9. The semiconductor device as recited in claim 7, wherein the clock edge detecting unit outputs a falling edge detection signal that is toggled in response to a falling edge of the clock output from the frequency divider.

10. The semiconductor device as recited in claim 7, wherein the clock edge detecting unit outputs a clock edge detection signal that is toggled in response to a rising edge and a falling edge of the clock output from the frequency divider.

11. An internal voltage generating circuit of a semiconductor device, comprising:

a voltage level detecting unit configured to detect a level of an internal voltage terminal, based on a target level, and generate a first driving control pulse having an activation period varying according to the detection result;

a first driver configured to pull up the internal voltage terminal in response to the first driving control pulse;

a frequency detecting unit configured to receive and detect a frequency of an external clock and generate a periodic driving control signal having a predefined active pulse width in each period of periods of the periodic driving control signal, wherein the periods of the periodic driving control signal vary in response to the frequency of the external clock and the predefined activation pulse width remains the same in response to variations in the frequency of the external clock; and a second driver configured to pull up the internal voltage terminal in response to the periodic driving control signal, regardless of a level variation of the voltage level of the internal voltage terminal.

12. The internal voltage generating circuit as recited in claim 11, wherein the voltage level detecting unit activates the first driving control pulse during a period where the level of the internal voltage terminal is lower than the target level, and deactivates the first driving control pulse during a period where the level of the internal voltage terminal is higher than the target level.

13. The internal voltage generating circuit as recited in claim 11, wherein the first driver pulls up the internal voltage terminal with a first drivability during the activation period of the first driving control pulse.

14. The internal voltage generating circuit as recited in claim 11, wherein the frequency detecting unit activates the periodic driving control signal for a predefined time in response to predefined toggling numbers of the external clock.

15. The internal voltage generating circuit as recited in claim 11, wherein the second driver pulls up the internal voltage terminal with a second drivability during the activation period of the external clock.

16. The internal voltage generating circuit as recited in claim 11, wherein the frequency detecting unit comprises:

a buffer configured to buffer the external clock in response to an operation control signal;

a frequency dividing unit configured to divide an output clock of the buffer by a predefined multiple; and a periodic driving control pulse generator configured to generate the periodic driving control signal having the predefined activation pulse width at each edge of a clock output from the frequency divider.

17. The internal voltage generating circuit as recited in claim 16, wherein the frequency detecting unit, further comprises, a reset controller configured to reset the frequency divider and the second driving control pulse generator in response to the operation control signal.

18. The internal voltage generating circuit as recited in claim 16, wherein the periodic driving control pulse generator comprises:

a clock edge detecting unit configured to detect an edge of a clock output from the frequency divider; and a second driving control pulse period determining unit configured to activate the periodic driving control signal in response to the output signal of the clock edge detecting unit, and deactivate the periodic driving control signal after a predefined time elapses.

19. An internal voltage generating circuit of a semiconductor device, comprising:

a first voltage driver configured to compare an internal voltage terminal with a reference voltage to pull up the internal voltage terminal during a period where a level of the internal voltage terminal is lower than the reference voltage; and a second voltage driver configured to pull up the internal voltage terminal during a predefined time in each period corresponding to a frequency of an external clock CLK, regardless of a level variation of the voltage level of the internal voltage terminal, wherein the second voltage driver comprises:

a frequency detecting unit configured to detect the frequency of the external clock and generate a periodic driving control signal having a predefined activation period in each period varying according to the detection result; and a first driving unit configured to pull up the internal voltage terminal in response to the periodic driving control signal, wherein the frequency detecting unit comprises:

a buffer configured to buffer the external clock in response to an operation control signal:

a frequency divider configured to divide an output clock of the buffer by a predefined multiple; and a detection pulse generator configured to generate the periodic driving control signal having the predefined activation period at each edge of a clock output from the frequency divider.

20. The internal voltage generating circuit as recited in claim 19, further comprising a bandgap reference voltage generator configured to generate the reference voltage which is constantly maintained at a target level, regardless of process, voltage and temperature (PVT) of the semiconductor device.

21. The internal voltage generating circuit as recited in claim 19, wherein the first voltage driver comprises:

a level detecting unit configured to detect the level of the internal voltage terminal, based on a target level, and generate a first driving control pulse; and a second driving unit configured to pull up the internal voltage terminal in response to an output signal of the level detecting unit.

22. The internal voltage generating circuit as recited in claim 19, wherein the frequency detecting unit, further comprises, a reset controller configured to reset the frequency divider and the detection pulse generator in response to the operation control signal.

23. The internal voltage generating circuit as recited in claim 19, wherein the detection pulse generator comprises:

a clock edge detecting unit configured to detect an edge of a clock output from the frequency divider; and a detection pulse output unit configured to activate the detection pulse for a predefined time in response to an output signal of the clock edge detecting unit.

* * * * *